US007555881B2

(12) United States Patent
Spatafora et al.

(10) Patent No.: US 7,555,881 B2
(45) Date of Patent: Jul. 7, 2009

(54) METHOD AND UNIT FOR FEEDING PRODUCTS TO A GROUP-FORMING UNIT

(75) Inventors: Mario Spatafora, Granarolo (IT); Enrico Campagnoli, S. Agata Bolognese (IT); Fabrizio Tale', Bologna (IT)

(73) Assignee: G.D Societa' per Azioni, Bologna (IT)

( * ) Notice: Subject to any disclaimer, the term of this patent is extended or adjusted under 35 U.S.C. 154(b) by 159 days.

(21) Appl. No.: 11/839,028

(22) Filed: Aug. 15, 2007

(65) Prior Publication Data

US 2008/0072544 A1 Mar. 27, 2008

(30) Foreign Application Priority Data

Aug. 17, 2006 (IT) ..... BO2006A0611

(51) Int. Cl.
*B65B 35/56* (2006.01)

(52) U.S. Cl. ..... 53/446; 53/251; 198/460.1; 198/812

(58) Field of Classification Search ..... 53/251, 53/446, 442, 557; 198/460.2, 460.1, 812
See application file for complete search history.

(56) References Cited

U.S. PATENT DOCUMENTS 6,213,281 B1 * 4/2001 Biondi et al. ..... 198/407
7,225,601 B2 * 6/2007 Spatafora ..... 53/542
7,341,141 B2 * 3/2008 Spatafora ..... 198/460.2
2008/0250757 A1 * 10/2008 Blome ..... 53/371.8

FOREIGN PATENT DOCUMENTS

| | | |
|---|---|---|
| DE | 1124584 | 3/1962 |
| DE | 2618905 | 11/1977 |
| EP | 1388509 A1 | 2/2004 |
| EP | 1721844 A1 | 11/2006 |

* cited by examiner

*Primary Examiner*—Thanh K Truong
(74) *Attorney, Agent, or Firm*—McCarter & English, LLP

(57) ABSTRACT

A method and unit for feeding products to a group-forming unit forming groups of products, each defined by a given number of products; an orderly succession of products is fed in a first direction by a first conveyor; the products are transferred from the first conveyor to a second conveyor by a first transfer device; an orderly succession of products is fed in a second direction by the second conveyor; the products are transferred from the second conveyor to a third conveyor by a second transfer device; an orderly succession of products is fed by the third conveyor in a third direction parallel to the second direction; and, when a vacancy is detected on the first transfer device, the second conveyor is stopped, and, at the same time, the second transfer device is moved towards the first transfer device in the opposite direction to the second direction.

48 Claims, 5 Drawing Sheets

METHOD AND UNIT FOR FEEDING PRODUCTS TO A GROUP-FORMING UNIT

TECHNICAL FIELD

The present invention relates to a method and unit for feeding products to a group-forming unit.

The present invention may be used to advantage for feeding packets of cigarettes from a cellophaning machine to a cartoning machine, to which the following description refers purely by way of example.

BACKGROUND ART

Normally, packets of cigarettes are fed from a cellophaning machine to a cartoning machine on a single pocket feed conveyor, which feeds the packets directly from the cellophaning machine to the cartoning machine in a single orderly succession, and so constitutes both an output conveyor of the cellophaning machine and an input conveyor of the cartoning machine. This solution has the obvious advantage of maintaining timing between the two machines, but also the obvious disadvantage of in no way allowing for compensating any gaps, i.e. empty pockets, on the transfer conveyor, and so preventing the formation of incomplete groups on the cartoning machine.

To compensate any gaps, it has been proposed to keep the output conveyor of the cellophaning machine separate from the input conveyor of the cartoning machine, and to interpose an interoperational (preferably FIFO) store between the two. The store is supplied by the output conveyor of the cellophaning machine with a first orderly succession of packets of cigarettes in time with the cellophaning machine; and the packets of cigarettes are brought together inside the store into queues, are withdrawn from the queues in the store by the input conveyor of the cartoning machine, and are again arranged into a second succession in time with the cartoning machine. As such, any gaps along the output conveyor of the cellophaning machine are compensated, but at the expense of a loss of synchronization of the two machines. What is more, at relatively high production speeds, withdrawing the packets of cigarettes from the queues in the store is not easy, and may result in damage to the packets of cigarettes.

Patent Application EP1721844A1 proposes a unit for feeding packets of cigarettes from a cellophaning machine to cartoning machine, in which a first pocket output conveyor of the cellophaning machine and a second pocket input conveyor of the cartoning machine travel continuously in first and second opposite directions respectively, and are connected to each other by a pocket transfer wheel interposed between the first and second conveyor. The pocket transfer wheel can be operated to rotate about an axis of rotation crosswise to the first and second conveyor; or to translate together with the second conveyor and crosswise to the axis of rotation to compensate one or more gaps on the first conveyor; or to translate together with the first conveyor and crosswise to the axis of rotation to form a succession of gaps, in time with the cartoning machine, on the second conveyor.

The feed unit in Patent Application EP1721844A1 has several drawbacks, by not allowing for positioning the heat-shrink devices as required to obtain high-quality plastic overwrappings of the packets of cigarettes, and by coping poorly with sharp deceleration (or sudden stoppages) of the cartoning machine. That is, given its greater inertia, the cellophaning machine cannot slow down or stop as fast as the cartoning machine, with the result that, in the event of sharp deceleration (or sudden stoppage) of the cartoning machine, a certain number of packets of cigarettes are inevitably fed onto the output conveyor of the cellophaning machine, and, not being feedable to the cartoning machine, are necessarily rejected.

Patent Application DE2618905A1 describes a transfer unit for transferring individual cigarettes between two conveyors, and for compensating any difference in the speed of the two conveyors. A first pocket output conveyor and a second pocket input conveyor travel continuously in first and second opposite, parallel directions respectively, and are connected to each other by a pocket transfer drum, which is interposed between the first and second conveyor, and rotates about an axis of rotation crosswise to the first and second conveyor to transfer cigarettes between the two conveyors. In the event of a difference in the speed of the two conveyors, the transfer drum translates, together with one of the two conveyors, in the first or second direction.

Patent Application DE1124584A1 describes a transfer unit for transferring products between two belt conveyors travelling at two different speeds, and for compensating the difference in the speed of the two conveyors. A first belt conveyor and a second belt conveyor travel continuously in first and second opposite, parallel directions respectively, and are connected to each other by a third belt conveyor, which is interposed between the first and second conveyor, and translates back and forth in the first or second direction.

DISCLOSURE OF THE INVENTION

It is an object of the present invention to provide a method and unit for feeding products to a group-forming unit, which method and unit are designed to eliminate the aforementioned drawbacks, while at the same time being cheap and easy to implement.

According to the present invention, there are provided a method and unit for feeding products to a group-forming unit, as claimed in the attached Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
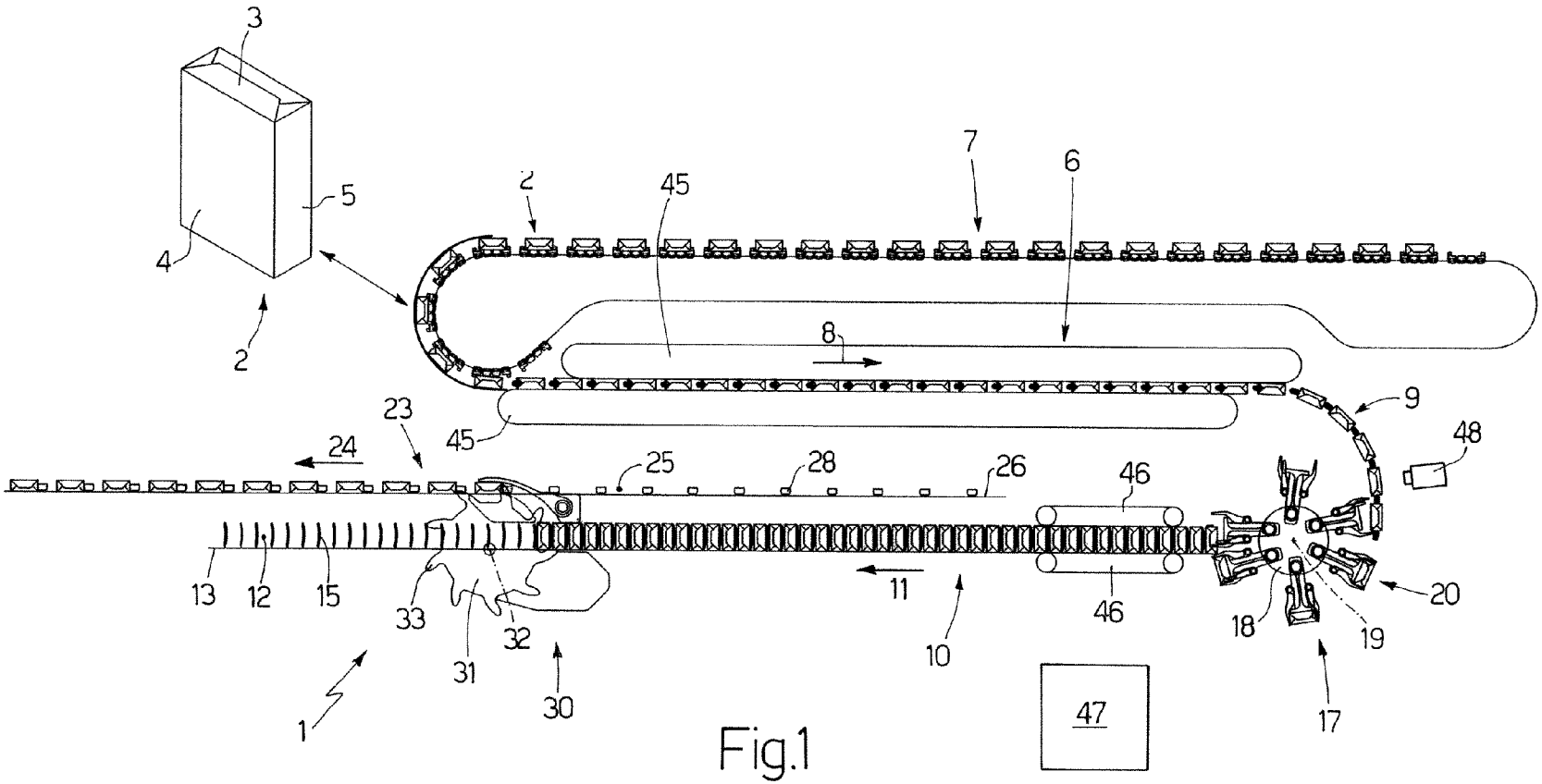
FIG. 1 shows a schematic side view, with parts removed for clarity, of a unit for feeding packets of cigarettes from a cellophaning machine to a cartoning machine, in accordance with the present invention.

Number 1 in FIG. 1 indicates as a whole a unit for feeding packets 2 of cigarettes from a cellophaning machine (not shown) to a cartoning machine (not shown), which comprises a group-forming unit (not shown) for forming packets 2 of cigarettes into groups, each comprising a given number of (normally ten) packets 2 of cigarettes.

Each packet 2 of cigarettes has an overwrapping of heat-shrink plastic material applied by the cellophaning machine, is in the form of a rectangular parallelepiped, and comprises two parallel end walls 3 (only one shown in FIG. 1), two parallel major lateral walls 4 (only one shown in FIG. 1), and two parallel minor lateral walls 5 (only one shown in FIG. 1).

Feed unit 1 comprises a conveyor 6, which receives packets 2 of cigarettes from a heat-seal conveyor 7 of the cellophaning machine, along which the superimposed portions of the overwrapping of plastic material at the two end walls 3 of each packet 2 of cigarettes are heat sealed. Conveyor 6 feeds an orderly succession of packets 2 of cigarettes in a direction 8, and comprises a succession of pockets 9, each housing a respective packet 2 of cigarettes. In a preferred embodiment shown in FIG. 1, conveyor 6 comprises a conveying surface having a flat, horizontal initial portion and a curved end portion; and a number of push members defining pockets 9 and which push packets 2 of cigarettes along the conveying surface.

Feed unit 1 comprises a conveyor 10, which is located below conveyor 6, feeds an orderly succession of packets 2 of cigarettes in a horizontal direction 11, and comprises a succession of pockets 12, each housing a respective packet 2 of cigarettes. In a preferred embodiment shown in FIG. 4, conveyor 10 comprises a centrally split conveying surface 13, along which packets 2 of cigarettes travel; and two lateral conveyor belts 14, each having a number of push members 15 defining pockets 12. More specifically, conveying surface 13 is split centrally to define a central opening 16.

Figure 2:
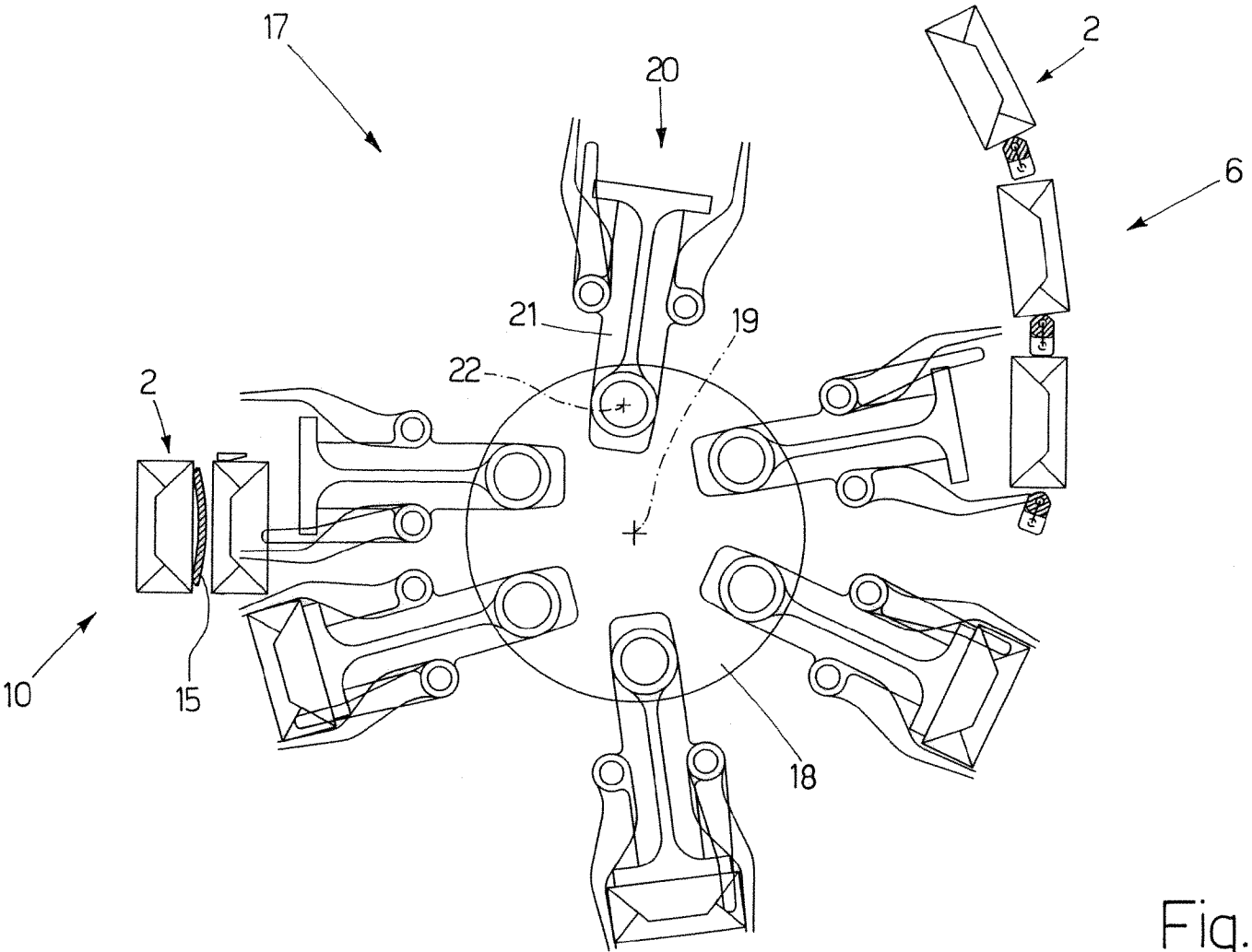
FIG. 2 shows a larger-scale view, with parts removed for clarity, of a first transfer device of the FIG. 1 feed unit.

As shown in FIGS. 1 and 2, feed unit 1 comprises a transfer device 17 for transferring packets 2 of cigarettes from conveyor 6 to conveyor 10. Transfer device 17 comprises a wheel 18, which rotates about a horizontal axis of rotation 19 perpendicular to the FIGS. 1 and 2 planes, and supports a number of pickup members 20, each of which removes a packet 2 of cigarettes from the output end of conveyor 6, and feeds the packet 2 of cigarettes to the input end of conveyor 10. Each pickup member 20 is fitted to an arm 21 hinged to wheel 18 to rotate, with respect to wheel 18 and under the control of a cam system (not shown), about an axis of rotation 22 parallel to axis of rotation 19.

Each pickup member 20 is preferably defined by a gripper having two jaws movable between a grip position, in which the two jaws are a minimum distance apart, and a release position, in which the two jaws are a maximum distance apart.

Figure 4:
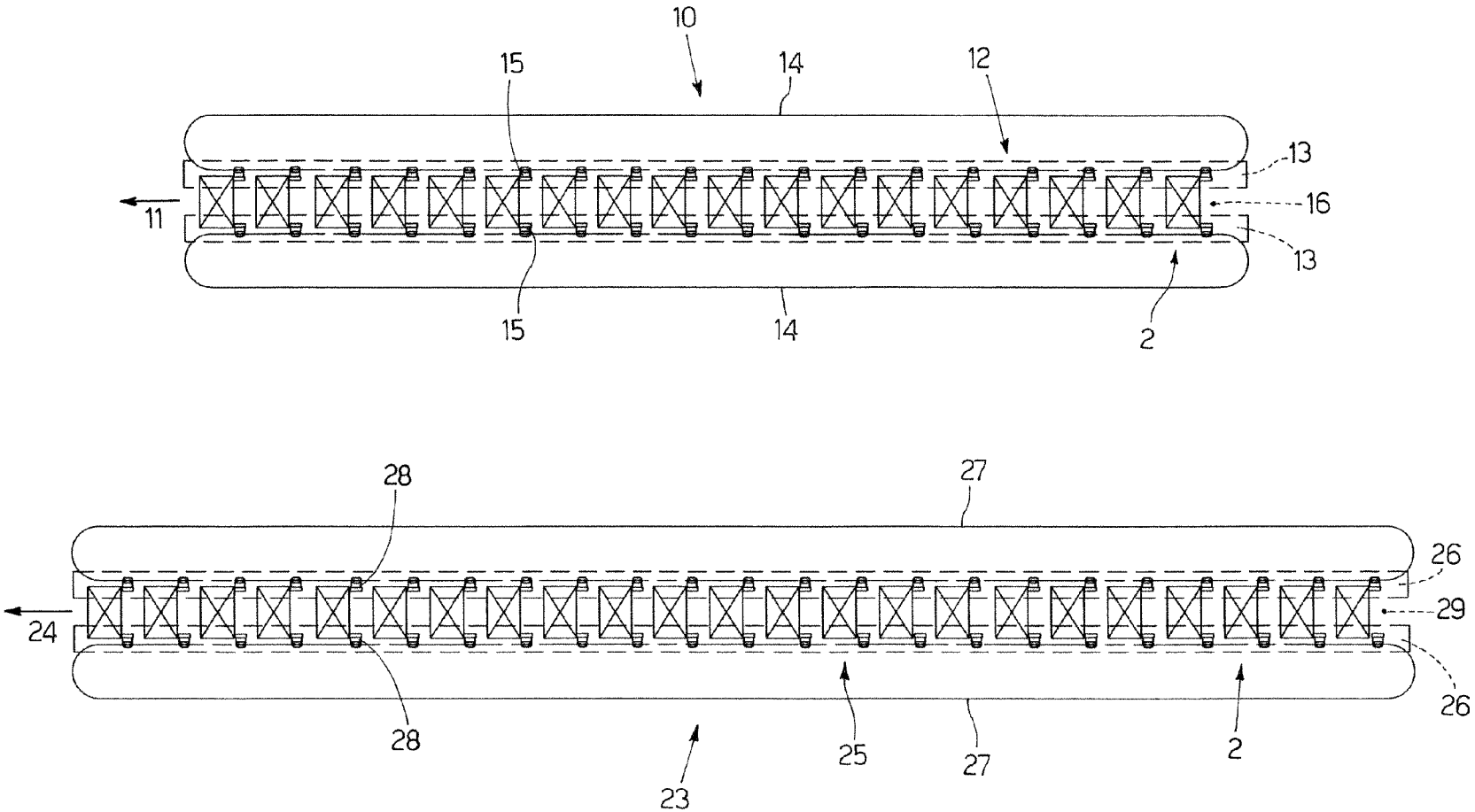
FIG. 4 shows a larger-scale plan view, with parts removed for clarity, of two conveyors of the FIG. 1 feed unit.

As shown in FIGS. 1 and 4, feed unit 1 comprises a conveyor 23, which feeds an orderly succession of packets 2 of cigarettes in a direction 24 parallel to direction 11, and comprises a succession of pockets 25, each housing a respective packet 2 of cigarettes. In a preferred embodiment shown in FIG. 4, conveyor 23 comprises a centrally split conveying surface 26, along which packets 2 of cigarettes travel; and two lateral conveyor belts 27, each having a number of push members 28 defining pockets 25. More specifically, conveying surface 26 is split centrally to define a central opening 29.

Figure 3:
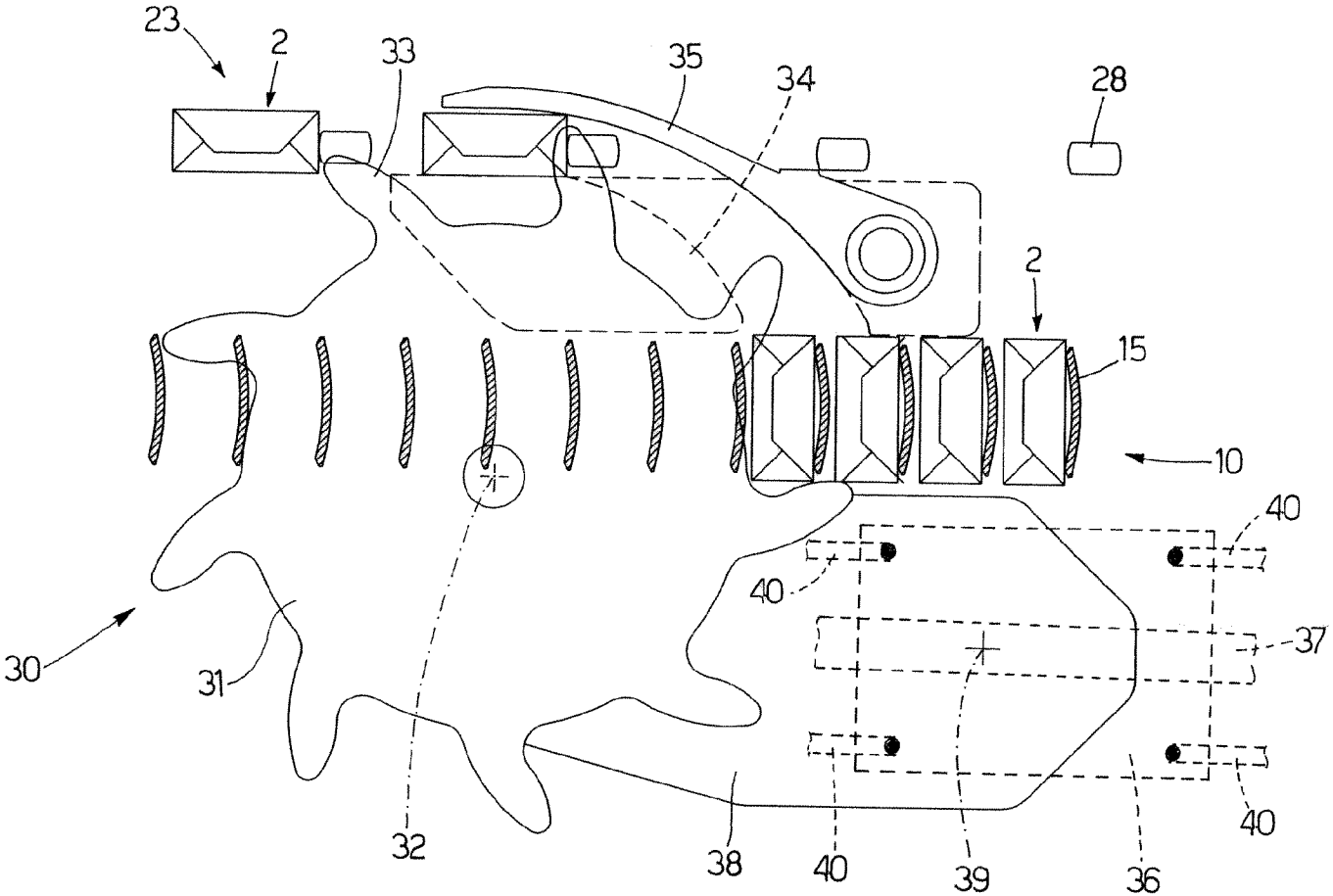
FIG. 3 shows a larger-scale view, with parts removed for clarity, of a second transfer device of the FIG. 1 feed unit.

As shown in FIGS. 1 and 3, feed unit 1 comprises a transfer device 30 for transferring packets 2 of cigarettes from conveyor 10 to conveyor 23. As described in detail below, transfer device 30 is movable both horizontally back and forth in direction 11, and vertically perpendicular to direction 11.

Transfer device 30 comprises a wheel 31, which rotates about a horizontal axis of rotation 32 parallel to axes of rotation 19 and 22, and supports a number of push members 33, each of which removes a packet 2 of cigarettes from a pocket 12 of conveyor 10, and feeds the packet 2 of cigarettes to a pocket 25 of conveyor 23. More specifically, each push member 33 is defined by a hook projecting from the lateral surface of wheel 31. Transfer device 30 also comprises a bottom plate 34 and a top plate 35 defining, in between, a feed channel along which each packet 2 of cigarettes is pushed by a push member 33. In other words, the feed channel is bounded internally by a curved surface of bottom plate 34, and externally by a curved surface of top plate 35. Top plate 35 is arc-shaped, and extends about wheel 31 to guide packets 2 of cigarettes. Preferably, top plate 35 is hinged to rotate between a work position (shown in the drawings) and a maintenance position, and is held in the work position by a push member (e.g. an air spring).

It is important to note that wheel 31 and plates 34 and 35 are small enough transversely (in width) to fit inside openings 16 and 29 of conveyors 10 and 23, so that the on-edge wheel 31 can move freely back and forth in direction 11 with respect to both conveyors 10 and 23, and a packet 2 of cigarettes can be engaged simultaneously by conveyor 10 or 23 (which engages packet 2 of cigarettes laterally) and by wheel 31 (which engages packet 2 of cigarettes centrally).

In a preferred embodiment shown in FIG. 3, to assist removal of a packet 2 of cigarettes from a pocket 12 of conveyor 10, push members 15 of conveyor 10 are the same curved shape as the feed channel defined between bottom plate 34 and top plate 35 of transfer device 30.

Finally, transfer device 30 comprises a carriage 36, which supports wheel 31 and is mounted to run along a guide 37 parallel to direction 11. More specifically, an arm 38 is hinged at a first end to carriage 36 to rotate about an axis of rotation 39 parallel to axis of rotation 32, and, at a second end, supports wheel 31 in rotary manner. Arm 38 also supports bottom plate 34 and top plate 35.

Figure 5:
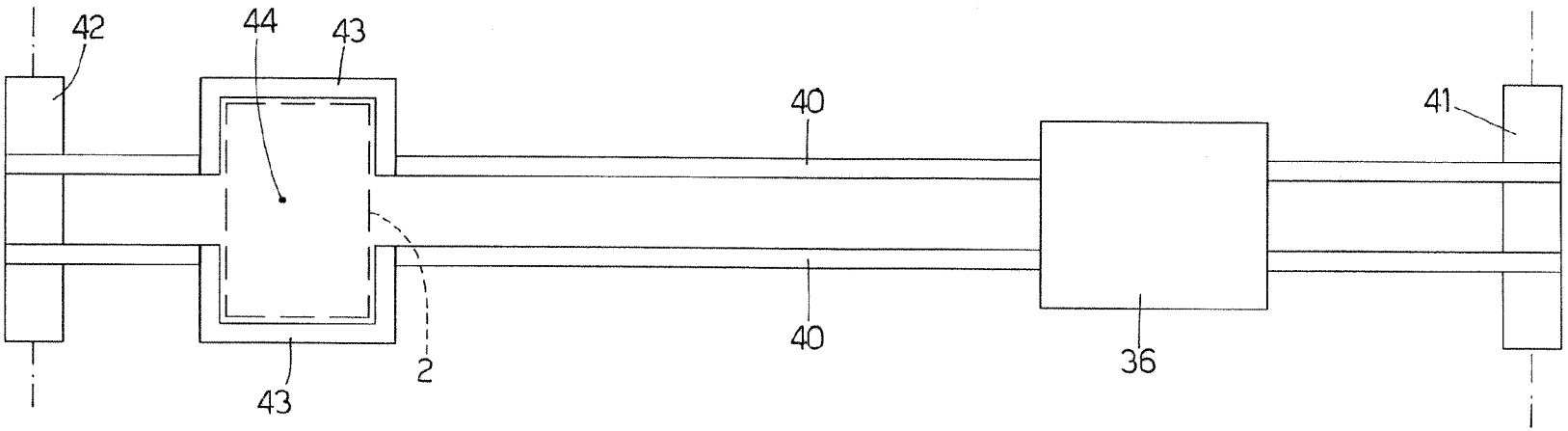
FIG. 5 shows a schematic plan view, with parts removed for clarity, of a carriage of the second transfer device in FIG. 3.

A preferred embodiment shown in FIGS. 3 and 5 comprises two belts 40 (only one shown in FIG. 3), each of which is integral with carriage 36 and wound about an idle pulley 41 and a powered pulley 42. Each belt 40 preferably comprises a toothed portion wound about powered pulley 42, which is also toothed; and a non-toothed portion wound about idle pulley 41, which is smooth. Each belt 40 comprises a U-shaped intermediate member 43 to locally increase the size of the gap between the two belts 40. In other words, the intermediate member 43 of one belt 40 and the corresponding intermediate member 43 of the other belt 40 are positioned opposite and facing each other to define, between the two belts 40, a window 44 (for the purpose described below) large enough to permit passage of a packet 2 of cigarettes.

With reference to FIG. 1, it is important to note that packets 2 of cigarettes are housed inside pockets 9 of conveyor 6 in a first position with respect to direction 8 (i.e. are "laid flat"), are housed inside pockets 12 of conveyor 10 in a second position with respect to direction 11 (i.e. are positioned "upright" or "on edge"), and are housed in pockets 25 of conveyor 23 in the first position with respect to direction 24 (i.e. are "laid flat"). More specifically, in the first position, major lateral walls 4 of each packet 2 of cigarettes are parallel to the relative direction, and minor lateral walls 5 are perpendicular to the relative direction; and, in the second position, major lateral walls 4 of each packet 2 of cigarettes are perpendicular to the relative direction, and minor lateral walls 5 are parallel to the relative direction. The two changes in the position of packets 2 of cigarettes are made by the two transfer devices 17 and 30, each of which rotates each packet 2 of cigarettes 90° about the central axis of symmetry of the packet to change the position of packet 2 of cigarettes.

As shown in FIG. 1, a heat-shrink device 45 subjects each packet 2 of cigarettes to a first heat-shrink operation along conveyor 6, and a further heat-shrink device 46 subjects each packet 2 of cigarettes to a second heat-shrink operation along conveyor 10. By virtue of the two changes in the position of packets 2 of cigarettes described above, heat-shrink device 45 heats major lateral walls 4 of each packet 2 of cigarettes, and heat-shrink device 46 heats minor lateral walls 5 of each packet 2 of cigarettes, so that the overwrapping of heat-shrink plastic material of each packet 2 of cigarettes is effectively smoothed over the whole lateral surface of the packet to obtain an extremely high finish quality.

As shown in FIG. 1, a control device 47 supervises operation of feed unit 1, and is connected to an optical sensor 48 for detecting an empty pickup member 20 (i.e. a vacancy) on transfer device 17. In an equivalent embodiment, optical sensor 48 may be located close to transfer device 17, as opposed to along conveyor 6. It should be pointed out that, operationwise, the location of optical sensor 48 is of no importance, in that a gap along conveyor 6 is automatically and predictably transmitted to transfer device 17, so the actual location of optical sensor 48 depends solely on how soon in advance the vacancy on transfer device 17 is to be detected.

Operation of feed unit 1 described above will now be described with reference to FIG. 1.

When feed unit 1 is running normally, the number of packets 2 of cigarettes coming off the cellophaning machine equals the number of packets 2 of cigarettes absorbed by the cartoning machine, so there are no empty pockets 9 (i.e. gaps) along conveyor 6; wheel 18 of transfer device 17 rotates about axis of rotation 19 in time with conveyor 6 and conveyor 10 to transfer packets 2 of cigarettes from pockets 9 of conveyor 6 to pockets 12 of conveyor 10, leaving no empty pockets 12; and wheel 31 of transfer device 30 remains in a fixed position (i.e. does not translate) and rotates about axis of rotation 32 in time with conveyor 10 and conveyor 23 to transfer packets 2 of cigarettes from pockets 12 of conveyor 10 to pockets 25 of conveyor 23, leaving no empty pockets 25.

When an empty pickup member 20 (i.e. a vacancy) is detected on transfer device 17, control device 47 stops conveyor 10 when the empty pickup member 20 is positioned facing the input end of conveyor 10, and simultaneously moves wheel 31 of transfer device 30 towards transfer device 17 in the opposite direction to direction 11, while keeping wheel 31 in time with conveyor 10 and conveyor 23 to transfer packets 2 of cigarettes from pockets 12 of conveyor 10 to pockets 25 of conveyor 23, leaving no empty pockets 25. The vacancy on transfer device 17 is thus eliminated, and there are still no gaps (i.e. empty pockets 12) along conveyor 10. In the event of a number of successive vacancies on transfer device 17, conveyor 10 is stopped until the vacancies are eliminated, and, at the same time, wheel 31 of transfer device 30 is moved towards transfer device 17.

Eliminating the vacancies on transfer device 17 as described above may obviously continue until wheel 31 of transfer device 30 reaches a limit stop close to transfer device 17; in which case, gaps (i.e. empty pockets 25) are inevitably formed along conveyor 23. Accordingly, control device 47 controls feed unit 1 to create along conveyor 23 a number of gaps which is a multiple of the number of packets 2 of cigarettes in each group of packets 2 of cigarettes. That is, when the cartoning machine receives a number of gaps equal to the number of packets 2 of cigarettes in each group of packets 2 of cigarettes, it performs a so-called "carton skip", i.e. cuts off supply of the packing materials, and performs a no-load cycle to avoid producing any rejects. In other words, when the vacancies on transfer device 17 can no longer be compensated, the remaining vacancies are transferred successively to conveyor 23, so they always equal a multiple of the number of packets 2 of cigarettes in each group of packets 2 of cigarettes, and the cartoning machine can perform even repeated "carton skips" to avoid producing rejects.

On nearing the limit stop close to transfer device 17, wheel 31 of transfer device 30 may be moved in direction 24 away from transfer device 17 into an intermediate position between its two limit stops, while at the same time forming along conveyor 23 a number of consecutive empty pockets 25 (gaps) equal to the number of packets 2 of cigarettes in each group of packets 2 of cigarettes. In which case, the cartoning machine again performs a "carton skip" to avoid producing rejects.

In the event of deceleration or stoppage of conveyor 23 (i.e. of the cartoning machine), control device 47 moves wheel 31 away from transfer device 17 in direction 24; and, when wheel 31 reaches the opposite limit stop to transfer device 17, control device 47 rejects the surplus packets 2 of cigarettes on conveyor 10. This situation is caused by the greater inertia of the cellophaning machine preventing it from slowing down or stopping as fast as the cartoning machine, with the result that, in the event of sharp deceleration (or sudden stoppage) of the cartoning machine, a certain number of packets 2 of cigarettes are inevitably fed onto conveyor 10, and, not being feedable to the cartoning machine, are necessarily rejected.

To reject the surplus packets 2 of cigarettes on conveyor 10, control device 47 moves transfer device 30 into a withdrawn position, moves conveyor 10 forwards to feed the packets 2 of cigarettes in direction 11 to the output end of conveyor 10, and allows the packets 2 of cigarettes to drop by force of gravity off the output end of conveyor 10 into a station (not shown) located beneath the output end to collect the reject packets 2 of cigarettes. The withdrawn position of transfer device 30 is obviously such as to allow packets 2 of cigarettes to travel freely along conveyor 10 and drop freely off the output end of conveyor 10. Consequently, to move transfer device 30 into the withdrawn position, carriage 36 is withdrawn from the output end of conveyor 10, and arm 38 is rotated downwards about axis of rotation 39. Moreover, when transfer device 30 is in the withdrawn position, the window 44 defined between the two belts 40 is aligned vertically with the output end of conveyor 10 to allow packets 2 of cigarettes to drop into the collecting station.

Feed unit 1 as described above has numerous advantages: it provides for positioning heat-shrink devices 45 and 46 as required to obtain high-quality plastic overwrappings of packets 2 of cigarettes; and copes excellently with sharp deceleration (or sudden stoppages) of the cartoning machine, so any packets 2 of cigarettes that cannot be fed to the cartoning machine are rejected.

The invention claimed is:

1. A method of feeding products to a group-forming unit forming groups of products (2), each comprising a given number of products (2); the method comprising the steps of:

feeding an orderly succession of products (2) in a first direction (8) by means of a first conveyor (6) having a succession of first pockets (9), each housing a respective product (2);

transferring the products (2) from the first conveyor (6) to a second conveyor (10) by means of a first transfer device (17);

feeding an orderly succession of products (2) in a second direction (11) by means of the second conveyor (10) having a succession of second pockets (12), each housing a respective product (2);

transferring the products (2) from the second conveyor (10) to a third conveyor (23) by means of a second transfer device (30);

feeding an orderly succession of products (2) in a third direction (24), parallel to the second direction (11), by means of the third conveyor (23) having a succession of third pockets (25), each housing a respective product (2);

detecting a vacancy on the first transfer device (17);

stopping the second conveyor (10), when a vacancy is detected on the first transfer device (17), and simultaneously moving the second transfer device (30) towards the first transfer device (17) in the opposite direction to the second direction (11); and moving the second transfer device (30) away from the first transfer device (17) in the third direction (24), so as to form along the third conveyor (23) a number of consecutive empty third pockets (25) equal to the number of products (2) in each group of products (2).

2. A method as claimed in claim 1, and comprising the further steps of:

positioning the products (2) inside the first pockets (9) of the first conveyor (6) in a first position with respect to the first direction (8);

changing the position of the products (2) by means of the first transfer device (17);

positioning the products (2) inside the second pockets (12) of the second conveyor (10) in a second position with respect to the second direction (11);

changing the position of the products (2) by means of the second transfer device (30);

positioning the products (2) inside the third pockets (25) of the third conveyor (23) in the first position with respect to the third direction (24).

3. A method as claimed in claim 2, wherein each product (2) is in the form of a rectangular parallelepiped, and comprises two parallel end walls (3), two parallel major lateral walls (4), and two parallel minor lateral walls (5); in the first position, the major lateral walls (4) are parallel to the relative direction, and the minor lateral walls (5) are perpendicular to the relative direction; and, in the second position, the major lateral walls (4) are perpendicular to the relative direction, and the minor lateral walls (5) are parallel to the relative direction.

4. A method as claimed in claim 2, wherein each product (2) is a packet having an overwrapping of heat-shrink plastic material; the method comprising the further steps of:

subjecting each product (2) to a first heat-shrink operation along the first conveyor (6) by means of a first heat-shrink device (45); and subjecting each product (2) to a second heat-shrink operation along the second conveyor (10) by means of a second heat-shrink device (46).

5. A method as claimed in claim 1, and comprising the further step, in the event of deceleration or stoppage of the third conveyor (23), of moving the second transfer device (30) away from the first transfer device (17) in the third direction (24).

6. A method as claimed in claim 5, and comprising the further step of rejecting the surplus products (2) on the second conveyor (10) when the second transfer device (30) reaches a limit stop.

7. A method as claimed in claim 6, wherein the step of rejecting the surplus products (2) on the second conveyor (10) comprises the further steps of:

moving the second transfer device (30) into a withdrawn position;

moving the second conveyor (10) forward to feed the products (2) in the second direction (11) to an output end of the second conveyor (10); and allowing the products (2) to drop by force of gravity off the output end of the second conveyor (10) into a station located beneath the output end to collect the reject products (2).

8. A method as claimed in claim 7, wherein the withdrawn position of the second transfer device (30) is such as to allow the products (2) to travel freely along the second conveyor (10) and to drop freely off the output end of the second conveyor (10).

9. A method as claimed in claim 7, wherein the second transfer device (30) is movable back and forth in the second direction (11), as well as vertically perpendicular to the second direction (11).

10. A method as claimed in claim 1, wherein the first transfer device (17) comprises a first wheel (18), which rotates about a first axis of rotation (19) and supports a number of first pickup members (20), each of which removes a product (2) from the output end of the first conveyor (6) and feeds the product (2) to the input end of the second conveyor (10).

11. A method as claimed in claim 10, wherein each first pickup member (20) is fitted to an arm (21) hinged to the first wheel (18) to rotate, with respect to the first wheel (18) and under the control of a cam system, about a second axis of rotation (22) parallel to the first axis of rotation (19).

12. A method as claimed in claim 11, wherein each first pickup member (20) comprises a gripper having two jaws movable between a grip position, in which the two jaws are a minimum distance apart, and a release position, in which the two jaws are a maximum distance apart.

13. A method as claimed in claim 1, wherein the second transfer device (30) comprises a second wheel (31), which rotates about a third axis of rotation (32) and supports a number of second pickup members (33), each of which removes a product (2) from a second pocket (12) of the second conveyor (10), and feeds the product (2) to a third pocket (25) of the third conveyor (23).

14. A method as claimed in claim 13, wherein each second pickup member (33) comprises a hook projecting from the lateral surface of the second wheel (31).

15. A method as claimed in claim 13, wherein the second transfer device (30) comprises an arc-shaped top plate (35) surrounding the second wheel (31) to guide the products (2).

16. A method as claimed in claim 15, wherein the top plate (35) is hinged to rotate between a work position and a maintenance position, and is held in the work position by a push member.

17. A method as claimed in claim 13, wherein the second transfer device (30) comprises a carriage (36) supporting the second wheel (31), and which is mounted to run along a guide (37) parallel to the second direction (11).

18. A method as claimed in claim 17, wherein the second transfer device (30) comprises an arm (38) having a first end hinged to the carriage (36), and a second end supporting the second wheel (31) in rotary manner.

19. A method as claimed in claim 17, wherein the second transfer device (30) comprises two belts (40), each integral with the carriage (36) and wound about an idle pulley (41) and a powered pulley (42).

20. A method as claimed in claim 19, wherein each belt (40) comprises at least one U-shaped intermediate member (43) to locally increase the size of the gap between the two belts (40).

21. A method as claimed in claim 19, wherein each belt (40) comprises a toothed portion wound about the powered pulley (42), and a non-toothed portion wound about the idle pulley (41).

22. A method as claimed in claim 1, wherein the second conveyor (10) comprises a centrally split first conveying surface (13) along which the products (2) travel; and two lateral first conveyor belts (14), each having a number of first push members (15) defining the second pockets (12); and the second transfer device (30) is inserted inside a first central opening (16) of the first conveying surface (13).

23. A method as claimed in claim 22, wherein the first push members (15) are curved.

24. A method as claimed in claim 1, wherein the third conveyor (23) comprises a centrally split second conveying surface (26) along which the products (2) travel; and two lateral second conveyor belts (27), each having a number of second push members (28) defining the third pockets (25); and the second transfer device (30) is inserted inside a second central opening (29) of the second conveying surface (26).

25. A feed unit for feeding products to a group-forming unit forming groups of products (2), each comprising a given number of products (2); the feed unit (1) comprising:

a first conveyor (6) for feeding an orderly succession of products (2) in a first direction (8), and having a succession of first pockets (9), each housing a respective product (2);

a second conveyor (10) for feeding an orderly succession of products (2) in a second direction (11), and having a succession of second pockets (12), each housing a respective product (2);

a first transfer device (17) for transferring the products (2) from the first conveyor (6) to the second conveyor (10);

a third conveyor (23) for feeding an orderly succession of products (2) in a third direction (24), parallel to the second direction (11), and having a succession of third pockets (25), each housing a respective product (2);

a second transfer device (30) for transferring the products (2) from the second conveyor (10) to the third conveyor (23);

a sensor (48) for detecting a vacancy on the first transfer device (17); and a control device (47) for stopping the second conveyor (10), when a vacancy is detected on the first transfer device (17), and simultaneously moving the second transfer device (30) towards the first transfer device (17) in the opposite direction to the second direction (11), and for moving the second transfer device (30) away from the first transfer device (17) in the third direction (24), so as to form along the third conveyor (23) a number of consecutive empty third pockets (25) equal to the number of products (2) in each group of products (2).

26. A feed unit as claimed in claim 25, wherein the products (2) are positioned inside the first pockets (9) of the first conveyor (6) in a first position with respect to the first direction (8), are positioned inside the second pockets (12) of the second conveyor (10) in a second position with respect to the second direction (11), and are positioned inside the third pockets (25) of the third conveyor (23) in the first position with respect to the third direction (24).

27. A feed unit as claimed in claim 26, wherein each product (2) is in the form of a rectangular parallelepiped, and comprises two parallel end walls (3), two parallel major lateral walls (4), and two parallel minor lateral walls (5); in the first position, the major lateral walls (4) are parallel to the relative direction, and the minor lateral walls (5) are perpendicular to the relative direction; and, in the second position, the major lateral walls (4) are perpendicular to the relative direction, and the minor lateral walls (5) are parallel to the relative direction.

28. A feed unit as claimed in claim 26, wherein each product (2) is a packet having an overwrapping of heat-shrink plastic material; the feed unit (1) comprising:

a first heat-shrink device (45) for subjecting each product (2) to a first heat-shrink operation along the first conveyor (6); and a second heat-shrink device (46) for subjecting each product (2) to a second heat-shrink operation along the second conveyor (10).

29. A feed unit as claimed in claim 25, wherein, in the event of deceleration or stoppage of the third conveyor (23), the control device (47) moves the second transfer device (30) away from the first transfer device (17) in the third direction (24).

30. A feed unit as claimed in claim 29, wherein the control device (47) rejects the surplus products (2) on the second conveyor (10) when the second transfer device (30) reaches a limit stop.

31. A feed unit as claimed in claim 30, wherein, to reject the surplus products (2) on the second conveyor (10), the control device (47) moves the second transfer device (30) into a withdrawn position, moves the second conveyor (10) forward to feed the products (2) in the second direction (11) to an output end of the second conveyor (10), and allows the products (2) to drop by force of gravity off the output end of the second conveyor (10) into a station located beneath the output end to collect the reject products (2).

32. A feed unit as claimed in claim 31, wherein the withdrawn position of the second transfer device (30) is such as to allow the products (2) to travel freely along the second conveyor (10) and to drop freely off the output end of the second conveyor (10).

33. A feed unit as claimed in claim 31, wherein the second transfer device (30) is movable back and forth in the second direction (11), as well as vertically perpendicular to the second direction (11).

34. A feed unit as claimed in claim 25, wherein the first transfer device (17) comprises a first wheel (18), which rotates about a first axis of rotation (19) and supports a number of first pickup members (20), each of which removes a product (2) from the output end of the first conveyor (6) and feeds the product (2) to the input end of the second conveyor (10).

35. A feed unit as claimed in claim 34, wherein each first pickup member (20) is fitted to an arm (21) hinged to the first wheel (18) to rotate, with respect to the first wheel (18) and under the control of a cam system, about a second axis of rotation (22) parallel to the first axis of rotation (19).

36. A feed unit as claimed in claim 34, wherein each first pickup member (20) comprises a gripper having two jaws movable between a grip position, in which the two jaws are a minimum distance apart, and a release position, in which the two jaws are a maximum distance apart.

37. A feed unit as claimed in claim 25, wherein the second transfer device (30) comprises a second wheel (31), which rotates about a third axis of rotation (32) and supports a number of second pickup members (33), each of which removes a product (2) from a second pocket (12) of the second conveyor (10), and feeds the product (2) to a third pocket (25) of the third conveyor (23).

38. A feed unit as claimed in claim 37, wherein each second pickup member (33) comprises a hook projecting from the lateral surface of the second wheel (31).

39. A feed unit as claimed in claim 37, wherein the second transfer device (30) comprises an arc-shaped top plate (35) surrounding the second wheel (31) to guide the products (2).

40. A feed unit as claimed in claim 39, wherein the top plate (35) is hinged to rotate between a work position and a maintenance position, and is held in the work position by a push member.

41. A feed unit as claimed in claim 37, wherein the second transfer device (30) comprises a carriage (36) supporting the second wheel (31), and which is mounted to run along a guide (37) parallel to the second direction (11).

42. A feed unit as claimed in claim 41, wherein the second transfer device (30) comprises an arm (38) having a first end hinged to the carriage (36), and a second end supporting the second wheel (31) in rotary manner.

43. A feed unit as claimed in claim 41, wherein the second transfer device (30) comprises two belts (40), each integral with the carriage (36) and wound about an idle pulley (41) and a powered pulley (42).

44. A feed unit as claimed in claim 43, wherein each belt (40) comprises at least one U-shaped intermediate member (43) to locally increase the size of the gap between the two belts (40).

45. A feed unit as claimed in claim 43, wherein each belt (40) comprises a toothed portion wound about the powered pulley (42), and a non-toothed portion wound about the idle pulley (41).

46. A feed unit as claimed in claim 25, wherein the second conveyor (10) comprises a centrally split first conveying surface (13) along which the products (2) travel; and two lateral first conveyor belts (14), each having a number of first push members (15) defining the second pockets (12); and the second transfer device (30) is inserted inside a first central opening (16) of the first conveying surface (13).

47. A feed unit as claimed in claim 46, wherein the first push members (15) are curved.

48. A feed unit as claimed in claim 25, wherein the third conveyor (23) comprises a centrally split second conveying surface (26) along which the products (2) travel; and two lateral second conveyor belts (27), each having a number of second push members (28) defining the third pockets (25); and the second transfer device (30) is inserted inside a second central opening (29) of the second conveying surface (26).

* * * * *